United States Patent [19]

Kyrö et al.

[11] Patent Number: 4,474,113

[45] Date of Patent: Oct. 2, 1984

[54] HOLLOW CHARGE OF A DIRECTED EXPLOSION EFFECT AS WELL AS METHOD FOR THE MANUFACTURE OF THE METALLIC CONE OF THE HOLLOW CHARGE

[75] Inventors: Kari Kyrö ; Reijo Levämäki; Pekka Sydänmäki, all of Helsinki, Finland

[73] Assignee: Oy Sica Ab, Helsinki, Finland

[21] Appl. No.: 420,523

[22] Filed: Sep. 21, 1982

[30] Foreign Application Priority Data

Oct. 28, 1981 [FI] Finland ..... 813380

[51] Int. Cl.[3] ..... F42B 1/02

[52] U.S. Cl. ..... 102/306; 102/476

[58] Field of Search ..... 102/306, 307, 476, 701

[56] References Cited

U.S. PATENT DOCUMENTS

| | | | |
|---|---|---|---|
| 2,441,388 | 5/1948 | Blackinton | 102/56 |
| 2,595,960 | 5/1952 | Lawrence | 102/24 HC |
| 3,027,838 | 4/1962 | Meddick | 102/24 |
| 3,224,368 | 12/1965 | House | 102/306 |
| 3,237,559 | 3/1966 | Auberlinder | 102/24 |
| 3,431,850 | 3/1969 | Christopher | 102/24 |
| 4,063,512 | 12/1977 | Davis | 102/52 |
| 4,080,898 | 3/1978 | Gleske | 102/24 HC |

FOREIGN PATENT DOCUMENTS

| | | | |
|---|---|---|---|
| 2904155 | 8/1980 | Fed. Rep. of Germany . | |
| 2081851 | 2/1982 | United Kingdom | 102/476 |

OTHER PUBLICATIONS

"A New Approach Toward Elimination of Slug in Shaped Charge Perforating", *Journal of Petroleum Technology,* Mar. 1958, German Publication, pp. 56 and 62.

Explosives, Rudolf Meyer, pp. 152–155, Encyclopedia of Explosives and Related Items, vol. 4.

*Primary Examiner*—Charles T. Jordan
*Assistant Examiner*—Ted L. Parr
*Attorney, Agent, or Firm*—Burns, Doane, Swecker & Mathis

[57] ABSTRACT

The invention is concerned with a hollow charge of a directed explosion effect as well as with a method for the manufacture of the metallic cone of the hollow charge. The hollow charge (1) comprises a mantle (2) of the charge portion, an explosive material (3) fitted inside the mantle, a detonator (7) fitted at one end of the charge (1), and a metal cone (5) fitted at the opposite end of the charge (1). The mantle (2) of the hollow charge (1) and the metal cone (5) are precisely centered on a common symmetry axis (6). The detonator (7) is also positioned on the said symmetry axis (6). According to the invention, as viewed from the direction of the object to be blasted, the shape of the cone (5), made of pure copper, of the hollow charge (1) is in such a way differential that the convexity (a) of the wall (9) of the cone (5), whose thickness is uniform within the area of the entire cone, from the wall of a straight cone of equal cone angle is less than the thickness of the wall (9) of the copper cone (5), preferably about one half of the said thickness of the wall (9) .

3 Claims, 2 Drawing Figures

HOLLOW CHARGE OF A DIRECTED EXPLOSION EFFECT AS WELL AS METHOD FOR THE MANUFACTURE OF THE METALLIC CONE OF THE HOLLOW CHARGE

BACKGROUND AND SUMMARY OF THE INVENTION

The present invention relates to a hollow charge of a directed explosion effect as well as a method for the manufacture of the metallic cone of the hollow charge.

The subject of the present invention is a hollow charge of a directed explosion effect. The charge comprises a mantle of the charge portion, an explosive material fitted inside the mantle, a detonator fitted at one end of the charge, and a metal cone fitted at the opposite end of the charge, the mantle of the charge and the metal cone being precisely centered on a common symmetry axis, on which the detonator is also positioned.

In the prior art, blocked mine shafts are opened by means of explosives, whereby the explosive material is placed as close to the vault formation as possible, or into the vault formation. It is a commonly occurring drawback that the positioning of the explosive close to the vault formation is difficult and dangerous, and that the power effect of the explosive may not achieve the desired result. The object of the present invention is to provide a considerable improvement in the opening of blocked or vaulted mine shafts by means of a hollow charge or mine charge in accordance with the invention, which charge is placed underneath the vault formation and directed towards the vault formation. The hollow charge in accordance with the invention may be detonated from a distant location, so that it is remote-operated.

The hollow charge in accordance with the invention is mainly characterized in that, as viewed from the direction of the object to be blasted, the shape of the cone, made of pure copper, of the hollow charge is in such a way differential that the convexity of the wall of the cone, whose thickness is uniform within the area of the entire cone, from the wall of a straight cone of equal cone angle is less than the thickness of the wall of the copper cone, preferably about one half of the said thickness of the wall, and that the point of the copper cone is preferably a part of a concave globe face, whereby, owing to the shape of the copper cone, when the hollow charge is being exploded, the differences in acceleration of the parts of its mass are as close to zero as is possible in practice.

In the hollow charges in use at present, only the point mass, the jet, is utilized, so that the mass chunk following behind, whose speed is 200 to 300 m/s, is not utilized. In the hollow charge or mine charge in accordance with the present invention, the jet and the chunk—i.e. the whole mass—travel at almost the same speed, as compared with each other, at about 2500 to 3000 m/s, while the detonating rate of the explosive is 7000 to 8000 m/s. This of course has entirely novel power effects. The copper cone of the hollow charge in accordance with the invention is specifically shaped so that the differences in acceleration between the parts of the mass are as close to zero as is possible in practice. The hollow charge operates by means of the spherical-front principle.

BRIEF DESCRIPTION OF THE DRAWINGS

The invention comes out in more detail from the following description and from the attached drawings, wherein.

DETAILED DESCRIPTION OF THE PREFERRED EMBODIMENTS

Figure 2:
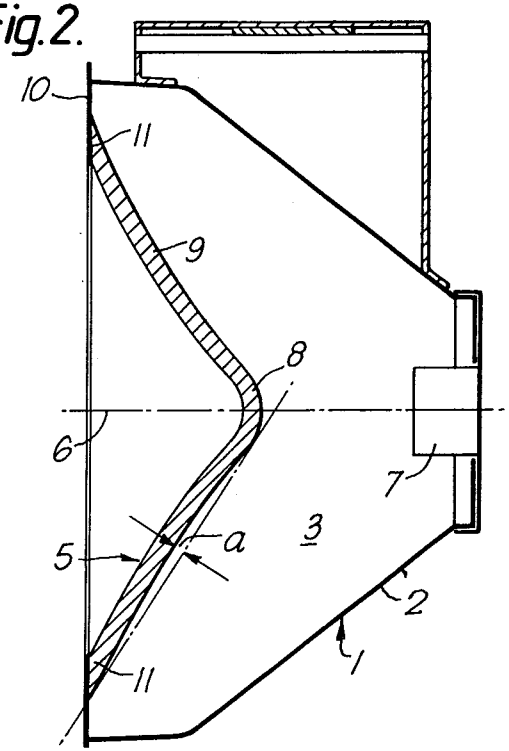
FIG. 1 shows a hollow charge in accordance with the invention as viewed from the direction of the copper cone and FIG. 2 shows a section at A—A in FIG. 1.
Figure 1:
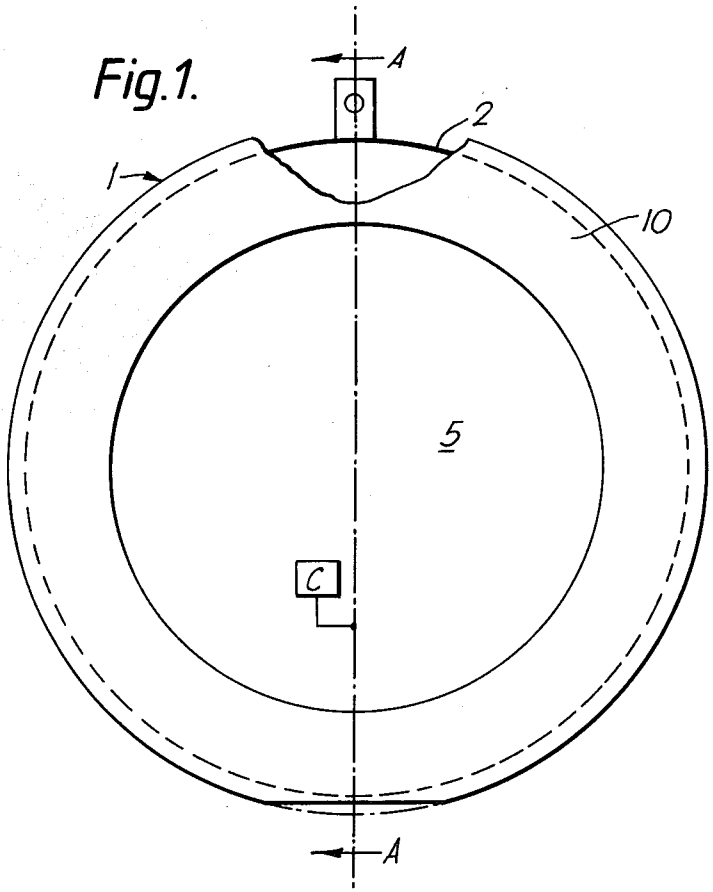

In accordance with FIGS. 1 and 2, the hollow charge 1 comprises a mantle 2 of the charge portion, an explosive material 3 fitted inside the mantle, a detonator 7 fitted at one end of the charge 1, and a metal cone 5 fitted at the opposite end of the charge. The mantle 2 of the hollow charge 1 and the metal cone 5 are precisely centered on a common symmetry axis 6, on which the detonator 7 is also positioned. The metallic cone 5 is differential, and it is pressed into a mould straight out of a hot-rolled sheet of pure copper without permitting a substantial cooling of the sheet after the hot-rolling. The location of the detonator 7 is determined in accordance with the differentiality of the copper cone 5, and its detonating rate is higher than the detonating rate of the explosive material.

As viewed from the object to be blasted, the shape of the cone 5, made of pure copper, of the hollow charge is in such a way differential that the convexity a of the wall 9 of the cone, whose thickness is uniform within the area of the entire cone, from the wall of a straight cone of equal cone angle is less than the thickness of the wall 9 of the copper cone 5 and preferably about one half of the said thickness of the wall 9. As comes out from FIG. 2, the point of the copper cone 5 is at both sides of the cone a part of a globe face. It is expressly owing to the differential shaping of the copper cone 5 that, when the hollow charge 1 is being exploded, the differences in acceleration between the parts of its mass become minimal. In the way coming out from FIG. 2, the edge portions 11 of the copper cone 5 are chamfered, and a plate ring 10 has been fastened to the copper cone 5 by soldering. By means of the plate ring 10, the copper cone 5 is attached to the mantle 2 of the hollow charge 1.

The shape of the mantle 2 is, at the end of the hollow charge 1 placed next to the copper cone 5, cylindrical and becomes narrower, having the shape of a truncated cone, towards the detonator 7. Owing to the shape of the mantle 2 and of the copper cone 5, the impact angle of the detonation wave in relation to the copper cone 5 is almost constant. As regards its shape, the hollow charge 1 in accordance with the invention may, of course, show variation within certain limits, however, so that the ratio of the quantity of explosive material to the quantity of material of the copper cone 5 is substantially constant.

The impact energy of the hollow charge in accordance with the invention is about 20 megajoules when the distance from the hollow charge to the object to be blasted is 15 meters and the weight of the mass formed is 6 kilograms and the speed 2500 m/s.

We claim:

1. A hollow charge of a directed explosion effect, which charge comprises a mantel of the charge portion, an explosive material fitted inside the mantel, a detonator fitted at one end of the charge, and a metal cone fitted at the opposite end of the charge, the mantel of the charge and the metal cone being precisely centered on a common symmetry axis on which the detonator is also positioned, the metal cone including a concave globe face, wherein a detonation wave of the charge is spherical and, that as viewed from a direction of an object to be blasted, the cone is shaped so as to define a convexity in the cone wall with respect to a wall of a straight cone of equal cone angle, the cone wall being of uniform thickness and the convexity being less than the thickness of the wall and preferably about ½ of the thickness, so that when the hollow charge is exploded, a jet and a slug formed thereby obtain a velocity of about 2,500 to 3,500 meters per second when detonation velocity of the explosive is 7,000 to 8,000 meters per second.

2. A hollow charge as claimed in claim 1, wherein the shape of the mantel is, at the end placed next to the cone, cylindrical and becomes narrower, having the shape of a truncated cone, towards the detonator so that the impact angle of the detonation wave in relation to the cone is almost constant.

3. A hollow charge as claimed in claim 2, wherein the metal cone is copper.

* * * * *